US010098423B1

(12) United States Patent
Cipolla

(10) Patent No.: US 10,098,423 B1
(45) Date of Patent: Oct. 16, 2018

(54) JEWELRY CLOSURE

(71) Applicant: Steven A. Cipolla, Warwick, RI (US)

(72) Inventor: Steven A. Cipolla, Warwick, RI (US)

(73) Assignee: National Chain Company, Warwick, RI (US)

( * ) Notice: Subject to any disclaimer, the term of this patent is extended or adjusted under 35 U.S.C. 154(b) by 149 days.

(21) Appl. No.: 15/233,064

(22) Filed: Aug. 10, 2016

(51) Int. Cl.
*A44C 5/20* (2006.01)
*A44C 11/00* (2006.01)

(52) U.S. Cl.
CPC ..... *A44C 5/2076* (2013.01); *A44C 11/00* (2013.01)

(58) Field of Classification Search
CPC ..... A44C 5/2076; A44C 11/00
See application file for complete search history.

(56) References Cited

U.S. PATENT DOCUMENTS

| | | | | |
|---|---|---|---|---|
| 4,231,137 | A | 11/1980 | Fujimoto | |
| 5,099,659 | A | 3/1992 | Carranza et al. | |
| 5,317,789 | A | 6/1994 | Levy | |
| 5,920,966 | A | 7/1999 | Chen | |
| 6,598,271 | B2 | 7/2003 | Nire | |
| 7,726,152 | B2 | 6/2010 | Beard | |
| 7,802,448 | B2 | 9/2010 | Chan | |
| 8,752,252 | B2 | 6/2014 | Ninomiya et al. | |
| 2014/0053374 | A1* | 2/2014 | Jepsen | A44C 5/18 24/303 |

* cited by examiner

*Primary Examiner* — Robert Sandy
*Assistant Examiner* — Louis A Mercado
(74) *Attorney, Agent, or Firm* — Salter & Michaelson

(57) ABSTRACT

A jewelry item that includes a main decorative stem; at least one cap member engaged over the main stem; a first magnet; and a second magnet. The main stem has a channel for receiving the first magnet therein, and the cap member also has a channel for receiving the second magnet therein. Both channels are constructed and arranged so that the first and second magnets are in juxtaposition when the cap member is engaged toward the main stem so that there is a magnetic attraction between the main decorative stem and the cap member.

20 Claims, 5 Drawing Sheets

JEWELRY CLOSURE

FIELD OF THE INVENTION

The present invention relates in general to a jewelry closure and pertains, more particularly, to a magnetic jewelry closure. Even more particularly, the present invention relates to a jewelry item that embodies both magnetic and threading features.

BACKGROUND AND SUMMARY OF THE INVENTION

There are a variety of different closures for jewelry items. However, many of these closures are not particularly effective in providing a secure closure. Accordingly, it is an object of the present invention to provide an improved jewelry closure and one that relies upon the application of both magnetic and mechanical threading concepts.

To accomplish the foregoing and other objects, features and advantages of the present invention there is provided a jewelry item comprising: a main decorative stem; at least one cap member engaged over the main stem; a first magnet; a second magnet; said main stem having a channel for receiving said first magnet therein; said cap member also having a channel for receiving said second magnet therein; both said channels constructed and arranged so that the first and second magnets are in juxtaposition when the cap member is engaged toward said main stem so that there is a magnetic attraction between the main decorative stem and the cap member.

In accordance with other aspects of the present invention the main stem is comprised of a threaded bolt; including a threaded nut that is threaded with the threaded bolt to form a decorative bolt/nut arrangement; both magnets have substantially the same diameter and the first magnet is longer than the second magnet; the channel in the main stem comprises an elongated passage that has a blind inner end, and the first magnet is elongated and accommodated in the elongated passage; the channel in the cap member is in the form of a blind hole, the cap member has an open end with internal thread so that the cap member is threaded onto the threaded bolt, and wherein the blind hole is disposed at en end of the cap member that is opposite to the open end; both magnets are glued into respective blind passage and blind hole; including a cap member engaged at each opposite end of the main stem; each cap member has a support loop for supporting the jewelry item from respective pieces of chain; one of the cap members is fixed to one end of the main stem and is absent any magnet; one of the cap members has a loop for supporting the jewelry item from a piece of chain; the cap member has an open end with internal thread so that the cap member is threaded onto the threaded bolt; the blind hole is disposed at an end of the cap member that is opposite to the open end of the cap member; the blind hole is disposed within the open end of the cap member; the cap member also includes a top lid having a securing loop attached thereto; wherein the lid is one of firmly attached to the cap member, hinged from the cap member, snap fitted with the cap member and fitted to the cap member with a clam shell fitting; wherein the cap member has an open end with internal thread so that the cap member is threaded onto the threaded bolt, wherein the channel in the cap member comprises a blind hole, and wherein the blind hole is in one of disposed within the open end and disposed at a top surface of the cap member; and also includes a top lid having a securing loop attached thereto.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 8:
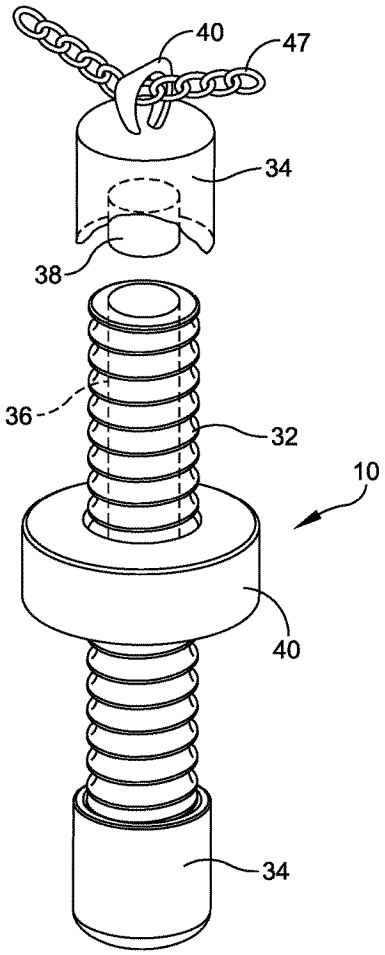
FIG. 8 is a perspective view similar to that shown in FIG. 7 but partially cut away to show the components.
Figure 7:
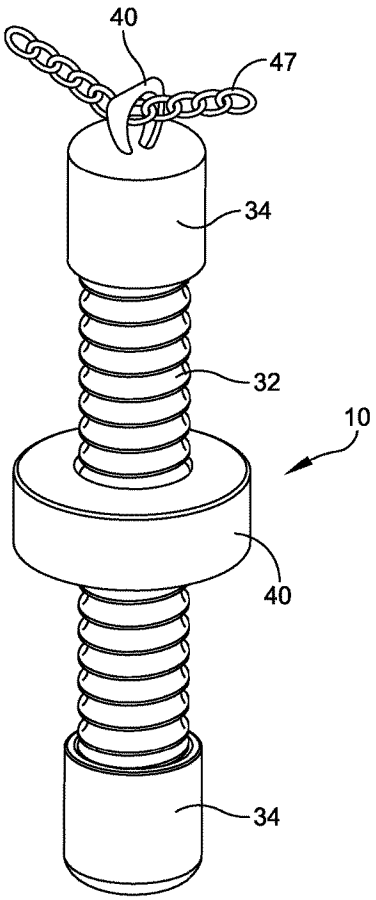
FIG. 7 is a perspective view for illustrating another embodiment of the present invention in which the jewelry item is suspended from a single chain.

The jewelry closure item of the present invention is illustrated in different embodiments herein. In each embodiment there is a main decorative stem and at least one cap member. In a first embodiment illustrated in FIGS. 1-5, the jewelry item is for support at opposed ends from a chain 22. Of course, the support of the jewelry item may be from other elongated filament members, other than a chain. In the embodiment of FIGS. 7 and 8, the jewelry item is supported at a single location from one of the cap members. This involves support at a loop of the cap member from a section of chain or other support filament.

Figure 1:
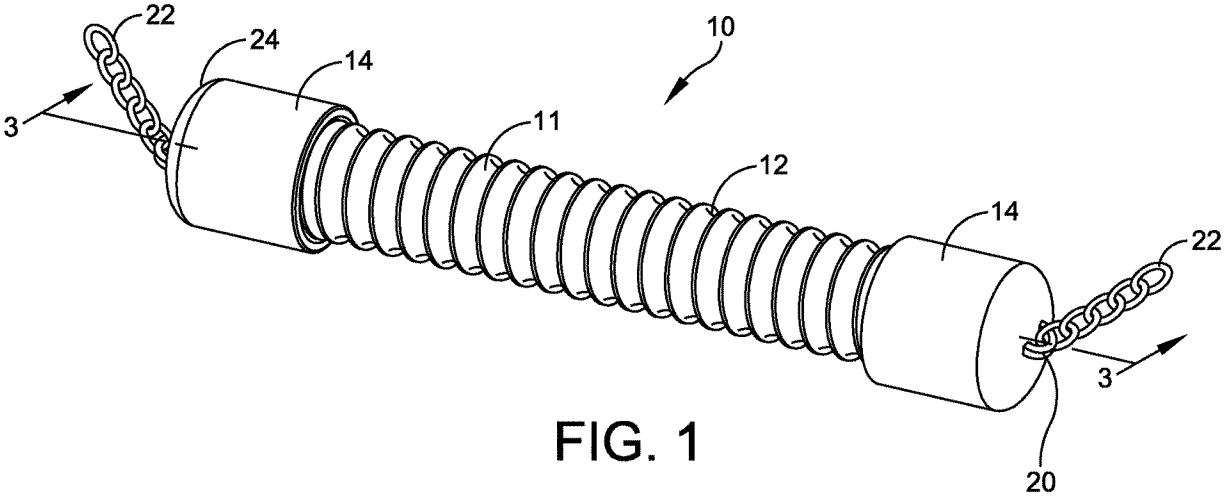
FIG. 1 is a perspective view of one embodiment of the jewelry closure of the present invention.
Figure 2:
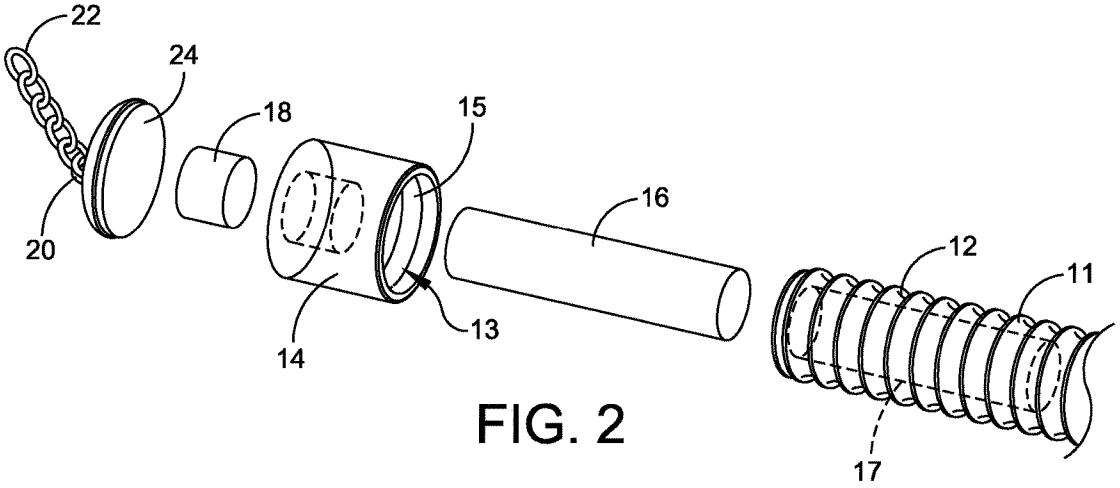
FIG. 2 is a partial exploded view of the jewelry item of FIG. 1.

In the embodiment illustrated in FIGS. 1-5 there is illustrated a jewelry item 10 that is comprised of a main decorative stem 12 and at least one cap member 14 that is engaged over the main stem. In the embodiment that is illustrated, the main decorative stem is in the form of a threaded bolt having threads 11. In FIG. 1 the magnetic attraction members may be associated with both of the cap members 14 or only with one of the cap members 14. FIG. 2 is a fragmentary exploded view showing one of the cap members 14.

The jewelry closure item also includes a first magnet 16 and a second magnet 18. The main stem 12 has a channel for receiving the first magnet therein. The cap member 14 also has a channel for receiving the second magnet therein. Both of these channels are constructed and arranged so that the first and second magnets are in juxtaposition when the cap member is engaged (threaded) onto the main decorative stem so that there is a magnetic attraction between the main decorative stem and the cap member.

Figure 3:
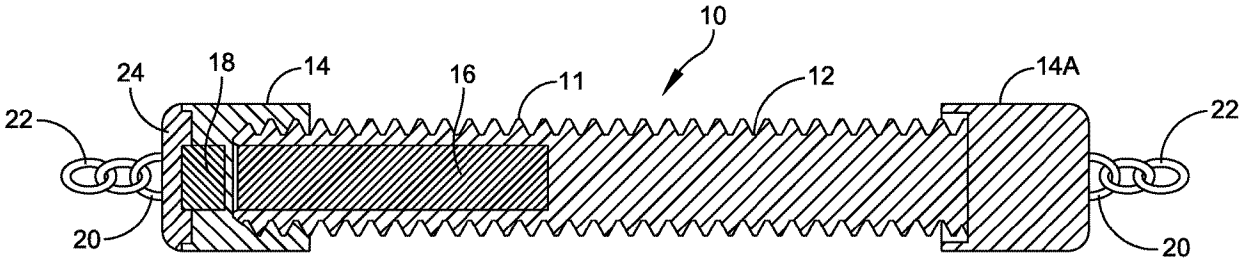
FIG. 3 is a cross-sectional view through the jewelry closure item of FIG. 1 as taken along line 3-3 of FIG. 1.
Figure 4:
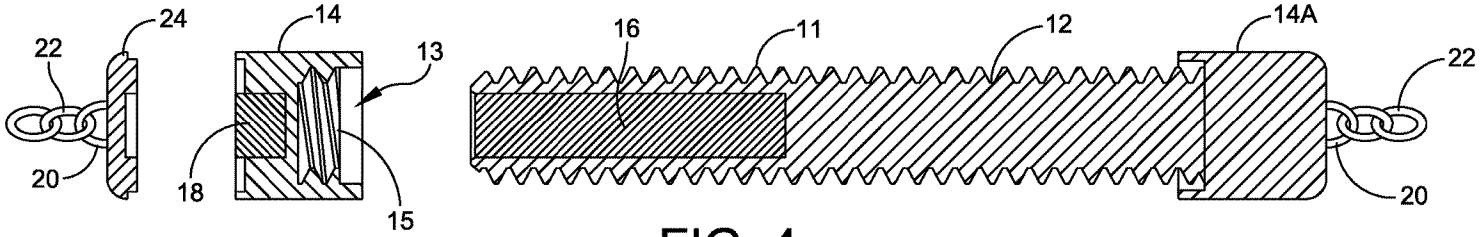
FIG. 4 is an exploded cross-sectional view showing the various components of the jewelry closure.
Figure 5:
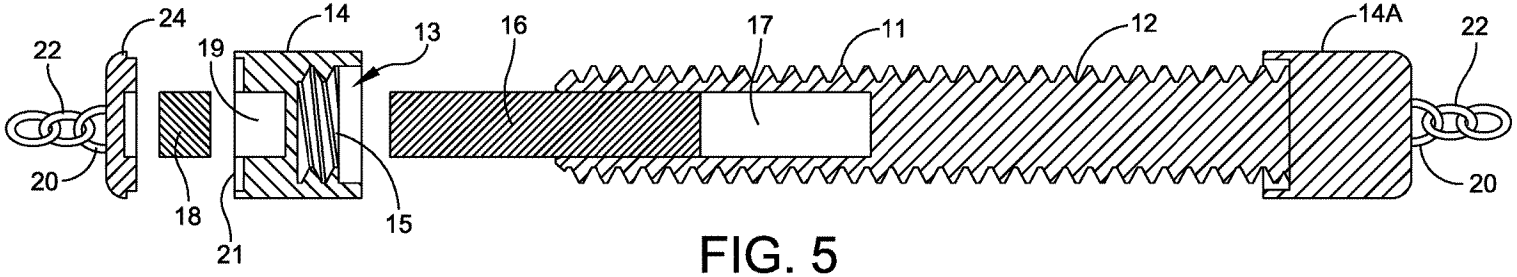
FIG. 5 is a further exploded cross-sectional view of the jewelry closure of FIG. 1.

Reference is also now made to FIGS. 3-5 for further details of the magnets 16 and 18. FIG. 3 is a cross-sectional view taken along line 3-3 of FIG. 1 with the left hand cap member 14 threadedly engaged with the threads 11 of the bolt 12. In that position, it is noted that the magnets 16 and 18 are closely spaced together. In FIGS. 3-5 there is shown a thin wall separating the magnets, however, in another version the magnets may be in contact or almost in contact. When the cap member 14 is first brought toward the stem, there is an attraction between the magnets 16 and 18 so that the cap member 14 is initially placed in a position at the beginning of the threads of the bolt 12. Thereafter, the user can rotate the cap member 14 relative to the bolt 12 for further securing the cap member 14 to the bolt 12. It is the cross-sectional view of FIG. 3 that shows the final position of the magnets with the cap member 14 fully threaded onto the bolt 12.

FIGS. 3-5 also illustrate, associated with the cap member 14, a lid 24. The lid 24 has a support loop 20 to which links of the chain 22 are connected. These links 22 and the loop 20 are shown in each of the cross-sectional views of FIGS. 3-5. In the particular embodiment of FIGS. 3-5 the opposite end cap member 14A is not provided with any magnet arrangement. However, in another embodiment both ends of the bolt may accommodate cap members of the same type as shown at the left in FIGS. 3-5.

In FIGS. 3-5 the cap member 14 is provided with an open end 13 that is internally threaded as indicated at 15 in FIGS. 4 and 5. FIG. 5 also illustrates an elongated open channel 17 for accommodating the elongated magnet 16. FIG. 5 illustrates the magnet 16 partially exploded out of the channel or passage 17, while FIG. 4 illustrates the magnet 16 fully inserted in position completely within the bolt 12. FIGS. 4 and 5 also illustrate a blind hole 19 at the top surface 21 of the cap member 14. This blind hole 19 is for accommodating the smaller magnet 18. FIG. 4 illustrates the magnet 18 in position within the blind hole 19 while FIG. 5 illustrates the magnet 18 exploded away from the blind hole 19. In this regard, refer also to the cross-sectional view of FIG. 3 which shows both of the magnets 16 and 18 in position. Both of the magnets 16 and 18, once placed in position such as shown in FIG. 4, may be glued into position so that they are effectively permanently attached to the respective bolt 12 and cap member 14.

Figure 6:
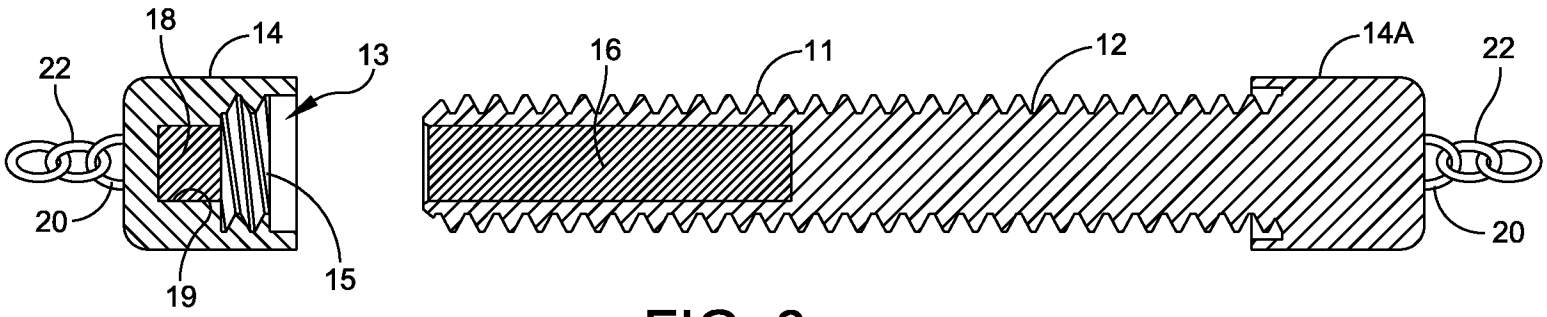
FIG. 6 is a cross-sectional view similar to that shown in FIG. 4 but for a different embodiment as to the manner in which the cap member magnet is supported.

Reference is now made to a cross-sectional view similar to that in FIG. 4 but for an alternate embodiment of the present invention. In FIG. 6 many of the same reference numbers are used. Thus, there is provided within the bolt 12, the elongated magnet 16 secured in position. Regarding the magnet 18 that is disposed in the cap member 14, rather than be inserted at the top surface 21, the cap member 14 is provided with an internally facing blind hole 19 into which the magnet 18 is inserted and secured such as by being glued therein.

Reference is now made to a further embodiment of the present invention illustrated in FIGS. 7 and 8. In the previous embodiment, in FIG. 1 there were opposite chain sections 22 for supporting opposite sides of the decorative item. In FIGS. 7 and 8, the jewelry item 10 is supported only at one end. Thus, in FIGS. 7 and 8, the top cap member 34 provides the means for support of the jewelry item from the chain 42. In FIGS. 7 and 8, the top cap member 34 is also provided with a magnet, illustrated at 38 in FIG. 8. The top surface of the cap member 34 is provided with a support loop 40 for support from the chain 42. FIG. 8 also illustrates the elongated magnet 36 that is disposed within the bolts 32. FIGS. 7 and 8 also illustrate the use of a decorative nut 40 that can be threaded along the bolt 32. Thus, the nut 40 would have internal threads. Also, additional decorative members may be threaded along the threaded shaft of the bolt 32 so as to provide a variety of decorative effects.

Figure 10:
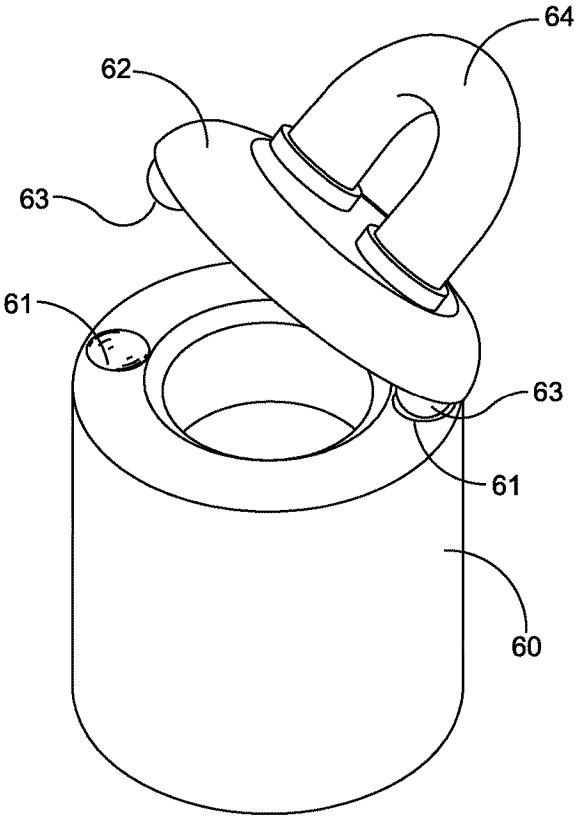
FIG. 10 is a perspective view illustrating still another embodiment of the cap member.
Figure 9:
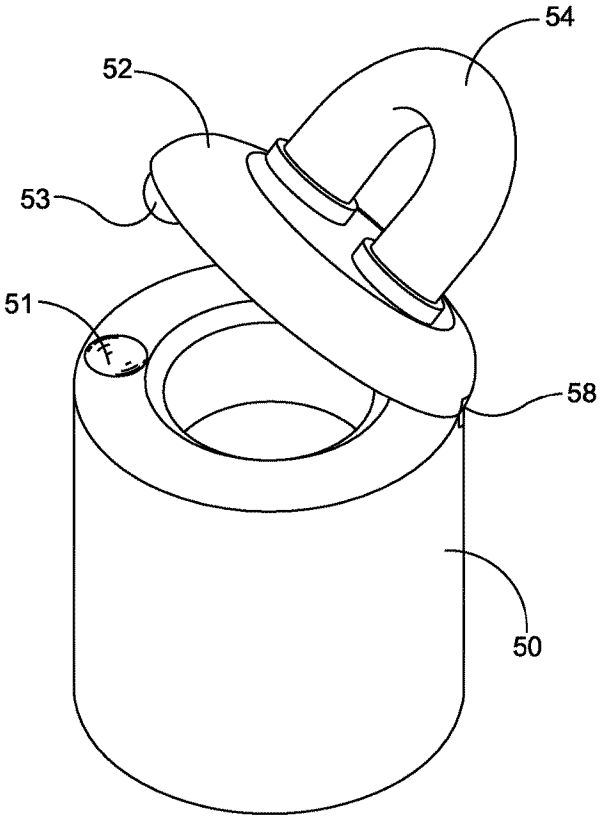
FIG. 9 is a perspective view of an alternate cap member employing a clamshell closure.

Reference is now also made to FIGS. 9 and 10 for an alternate arrangement of the cap member. Thus, in FIG. 9, there is provided a cap member 50 that may be provided with a top surface with a hole 51. FIG. 9 also illustrates a lid 52 with a support loop 54 and a dimple or post 53 that can engage with the hole 51. Also illustrated in FIG. 9 at 58 is a hinge connection that may be in the form of a clamshell type connection that enables access to the inside of the cap member 50, particularly when the magnet is being inserted from the top of the cap member. The clam shell is closed when the post 53 engages the hole 51. This engagement may be with a snap or force fit.

Reference is also now made to FIG. 10 for still a further embodiment of the present invention that comprises a cap member 60 having a pair of diametric hole 61 in a top surface. FIG. 10 also illustrates the lid 62 having a support loop 64 and a pair of diametrically disposed dimples or posts 63 that are to engage with respective holes 61. This engagement may be in a snap or force fit arrangement. It is intended that once the magnet for the cap member is in place, the magnet is glued in place and the lid is then secured over the cap member so that the lid and cap member essentially form a single cap member construction. As it is unlikely that the magnet will have to be replaced, this securing of the lid can be accomplished in a manner so that the cap member is permanently closed.

With regard to the securing of the magnet 18 in particular, there may not be a need for gluing the magnet in place as the magnet can be constructed to provide an attractive force relative to the lid 24; the lid 24 being of an attractive metallic material. It is also noted that the lid 24 may be provided with a small recess for accommodating an end of the magnet 18. FIGS. 4 and 5 illustrate this interlocking of the lid 24 with the cap member 14, and particularly FIG. 3 wherein the lid is shown fully engaged with the cap member.

Having now described a limited number of embodiments of the present invention, it should now be apparent to those skilled in the art that many other embodiments and modes thereof are contemplated as falling within the scope of the present invention. As indicated previously, a variety of different decorative nuts may be associated with the bolt. These decorative nuts can be of many different types of materials including plastic and metal materials. Regarding the elongated magnet 16, this is preferably secured in place by an adhesive or glue material.

What is claimed is:

1. A jewelry item comprising: a main stem; at least one cap member engaged over the main stem; a first magnet; a second magnet; said main stem having a channel for receiving said first magnet therein; the at least one cap member also having a channel for receiving said second magnet therein; both said channels constructed and arranged so that the first and second magnets are in juxtaposition when the at least one cap member is engaged toward said main stem so that there is a magnetic attraction between the main stem and the at least one cap member;

said main stem comprising a bolt having external threads; further including a threaded nut that is separate from the externally threaded bolt and that has internal threads that are threaded with, about and along the externally threaded bolt, the channel in the externally threaded bolt comprising a passage that has a blind inner end, and the first magnet is accommodated in the passage in the externally threaded bolt, the channel in the at least one cap member being in a form of a blind hole, the at least one cap member also having an open end with internal threads so that the at least one cap member is threaded onto the externally threaded bolt, and the second magnet is accommodated in the blind hole of the at least one cap member.

2. The jewelry item of claim 1 wherein both magnets have substantially the same diameter and the first magnet is longer than the second magnet.

3. The jewelry item of claim 1 wherein the blind hole is disposed at an end of the at least one cap member that is opposite to the open end.

4. The jewelry item of claim 3 wherein both magnets are glued into respective blind passage and blind hole.

5. The jewelry item of claim 1 wherein the at least one cap member includes a cap member engaged at each opposite end of the main stem.

6. The jewelry item of claim 5 wherein each cap member has a support loop for supporting the jewelry item from respective pieces of chain.

7. The jewelry item of claim 5 wherein one of the cap members is fixed to one end of the main stem and is absent any magnet.

8. The jewelry item of claim 5 wherein one of the cap members has a loop for supporting the jewelry item from a piece of chain.

9. The jewelry item of claim 1 wherein the channel in the main stem comprises an elongated passage that has a blind inner end, and the first magnet is elongated and accommodated in the elongated passage.

10. The jewelry item of claim 1 wherein the blind hole is disposed within the open end of the at least one cap member.

11. The jewelry item of claim 1 wherein the at least one cap member also includes a top lid having a securing loop attached thereto.

12. The jewelry item of claim 11 wherein the lid is one of firmly attached to the at least one cap member, hinged from the at least one cap member, snap fitted with the at least one cap member and fitted to the at least one cap member with a clam shell fitting.

13. The jewelry item of claim 11 the blind hole is in one of disposed within the open end and disposed at a top surface of the at least one cap member.

14. The jewelry item of claim 1 wherein the blind hole in the channel in the at least one cap member is within the open end of the at least one cap member.

15. The jewelry item of claim 1 wherein the blind hole in the channel in the at least one cap member is disposed at an opposite surface to a surface where the open end of the at least one cap member is formed.

16. The jewelry item of claim 15 wherein a dividing wall is formed in the at least one cap member between the blind hole and the open end.

17. The jewelry item of claim 16 wherein the at least one cap member also includes a top lid.

18. The jewelry item of claim 17 wherein the top lid has a securing loop attached thereto.

19. The jewelry item of claim 17 wherein the top lid has a recess for receiving a side of the second magnet.

20. The jewelry item of claim 1 wherein the bolt has external threads along substantially an entire length thereof.

* * * * *